US011769966B2

(12) United States Patent
Hsiao et al.

(10) Patent No.: US 11,769,966 B2
(45) Date of Patent: Sep. 26, 2023

(54) ANTI-ATTENUATION APPARATUS AND PLUG

(71) Applicant: Bizlink International Corp., New Taipei (TW)

(72) Inventors: Hsin-Tuan Hsiao, New Taipei (TW); Yi-Hsing Chung, New Taipei (TW)

(73) Assignee: Bizlink International Corp., New Taipei (TW)

( * ) Notice: Subject to any disclaimer, the term of this patent is extended or adjusted under 35 U.S.C. 154(b) by 101 days.

(21) Appl. No.: 17/384,917

(22) Filed: Jul. 26, 2021

(65) Prior Publication Data

US 2022/0037834 A1 Feb. 3, 2022

(30) Foreign Application Priority Data

Jul. 30, 2020 (TW) ..... 109125786

(51) Int. Cl.
*H01R 13/639* (2006.01)
*H01R 13/631* (2006.01)
*H01R 12/71* (2011.01)

(52) U.S. Cl.
CPC ..... *H01R 13/639* (2013.01); *H01R 12/716* (2013.01); *H01R 13/631* (2013.01)

(58) Field of Classification Search
CPC .. H01R 13/639; H01R 12/716; H01R 13/631; H01R 13/24; H01R 13/6581; H01R 12/714
See application file for complete search history.

(56) References Cited

U.S. PATENT DOCUMENTS 6,709,288 B1 * 3/2004 Hung ..... H01R 12/707 439/570
8,011,948 B2 9/2011 Wu
8,465,324 B2 * 6/2013 Ikari ..... H01R 13/6591 439/495
9,184,531 B2 * 11/2015 Chen ..... H01R 13/639
9,991,631 B2 * 6/2018 Zhao ..... H01R 13/6273
(Continued)

FOREIGN PATENT DOCUMENTS

CN 1361929 A 7/2002
TW M344629 U 11/2008
TW M346193 U 12/2008

*Primary Examiner* — Abdullah A Riyami
*Assistant Examiner* — Nelson R. Burgos-Guntin
(74) *Attorney, Agent, or Firm* — Alan D. Kamrath; Karin L. Williams; Mayer & Williams PC

(57) ABSTRACT

An anti-attenuation apparatus has an electronic device and a cable assembly. The electronic device has a circuit board and a plurality of metal pads mounted on the circuit board as female connecting spots. The cable assembly has a cable main body and an inserting connector. The inserting connector is mounted at an end of the cable main body and has multiple elastic components as male connecting spots. The female connecting spots and the male connecting spots selectively contact each other and thus the electric connection is formed. Therefore, the electronic device needs no additional socket and no additional connector as female connecting spots. Similarly, the cable assembly needs no additional connector for connecting the elastic component and the cable main body. In other words, twice attenuations are skipped in a set that has the electronic device and the cable assembly.

19 Claims, 10 Drawing Sheets

(56) References Cited

U.S. PATENT DOCUMENTS

| | | | | |
|---|---|---|---|---|
| 10,530,078 | B1 * | 1/2020 | Hsiao | H05K 1/09 |
| 10,833,439 | B2 * | 11/2020 | Wang | H01R 13/502 |
| 2006/0035515 | A1 * | 2/2006 | Pabst | H01R 12/88 439/492 |
| 2006/0084311 | A1 * | 4/2006 | Suzuki | H01R 12/771 439/260 |
| 2006/0183364 | A1 * | 8/2006 | Suzuki | H01R 12/88 439/260 |
| 2009/0163065 | A1 * | 6/2009 | Suzuki | H01R 12/88 439/312 |
| 2013/0143444 | A1 * | 6/2013 | Chen | H01R 13/518 439/626 |
| 2014/0273605 | A1 * | 9/2014 | Chang | H01R 4/2433 439/391 |
| 2014/0304985 | A1 * | 10/2014 | Nagase | H01R 12/79 29/747 |
| 2016/0322769 | A1 * | 11/2016 | Faith | H01R 13/6275 |
| 2017/0302023 | A1 * | 10/2017 | Kimura | G06K 13/02 |
| 2018/0159270 | A1 * | 6/2018 | Sato | H01R 13/62911 |
| 2020/0266566 | A1 * | 8/2020 | Shimada | H01R 13/639 |
| 2021/0234291 | A1 * | 7/2021 | Zerebilov | H01R 13/405 |
| 2021/0344141 | A1 * | 11/2021 | Yang | H01R 13/40 |
| 2021/0344142 | A1 * | 11/2021 | Chang | H01R 13/6272 |
| 2021/0376507 | A1 * | 12/2021 | Guo | H01R 13/113 |
| 2022/0037834 | A1 * | 2/2022 | Hsiao | H01R 13/639 |

* cited by examiner

ANTI-ATTENUATION APPARATUS AND PLUG

BACKGROUND OF THE INVENTION

1. Field of the Invention

The present invention relates to an anti-attenuation apparatus, especially to one having a securing assembly for securing a male connector onto a predetermined electronic device.

2. Description of the Prior Arts

Nowadays, in order to connect a cable with a circuit board, the cable has to be connected to a cable end connector, then the cable end connector can be inserted into a socket pre-soldered onto a circuit board of a device. The said socket is then called board end connector. Usually, the board end connector is a female-type connector and the cable end connector is a male-type connector.

In detail, the board end connector has a plurality of terminals, an end of each of the terminals is soldered onto the copper pad of the circuit board respectively and the other end of each of the terminals is connected to a terminal of the cable end connector respectively, so as to allow the cable end connector to be connected to the circuit board.

However, for some reasons, for example, terminals are not tightly connected, every junction suffers a certain level of signal strength loss, the said signal strength loss phenomenon is called "attenuation", which is unfavorable to signal transmission. In the foreseeable future, with the development of 5G communications, artificial intelligence, edge computing, and Internet of things devices, the increase of signal frequency and transmission volume makes the said matter of attenuation worse. The attenuation caused by transmission affects the signal quality more and more significantly.

To overcome the shortcomings, the present invention provides an anti-attenuation apparatus to mitigate or obviate the aforementioned problems.

SUMMARY OF THE INVENTION

The main objective of the present invention is to provide an anti-attenuation apparatus that requires no board end connector so to improve the attenuation problem in signal transmission by decreasing junctions between the cable and the circuit board. More specifically, the present invention discloses a securing assembly that is utilized to secure a male connector onto a circuit board directly, by omitting board end connector that pre-soldered onto a circuit board, resulting in less junctions, and therefore attenuation can be decreased accordingly.

The omission of the board end connector can be achieved by utilizing a male connector and a securing assembly pre-soldered onto a circuit board. The connector comprises a plurality of elastic terminals, each of the elastic terminals has an independent or common guiding unit connected at a front end thereof. When the male connector is plugged into the securing assembly, the guiding unit will be pressed downward toward the circuit board and the elastic terminal will be bent and be pressed onto the connecting pad of the circuit board. Accordingly, by omitting the conventional board end connector, an amount of junctions between cable and the circuit board can be decreased, which solves the attenuation problem so as to ensure the stability of high-frequency signal transmission.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
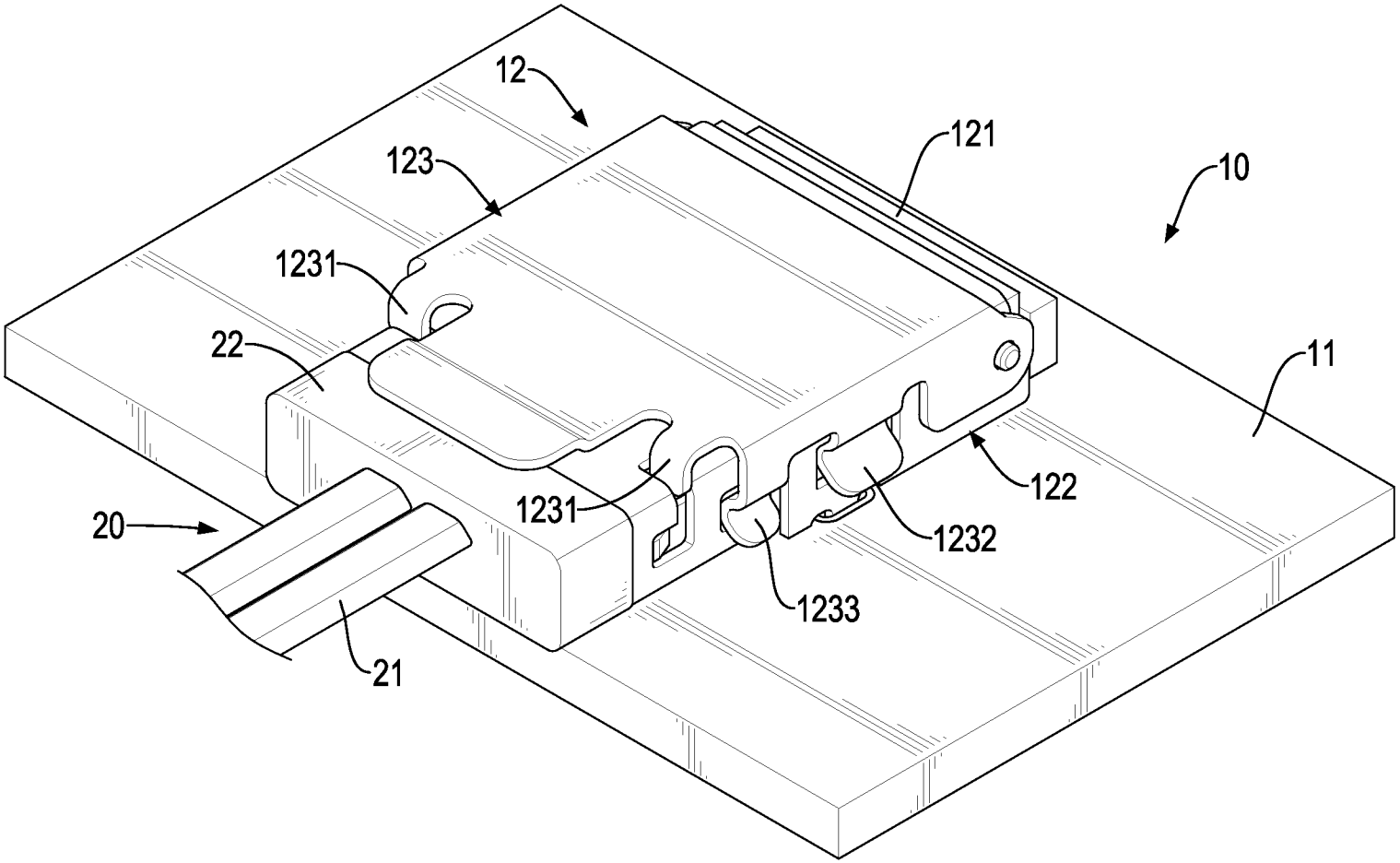
FIG. 1 is a perspective view of an anti-attenuation apparatus in accordance with an embodiment of the present invention.

With reference to FIG. 1, an anti-attenuation apparatus in accordance with one of the embodiments of the present invention is provided. The anti-attenuation apparatus comprises an electronic device 10 and a male connector 20 (which is a cable end connector in this embodiment).

Figure 2:
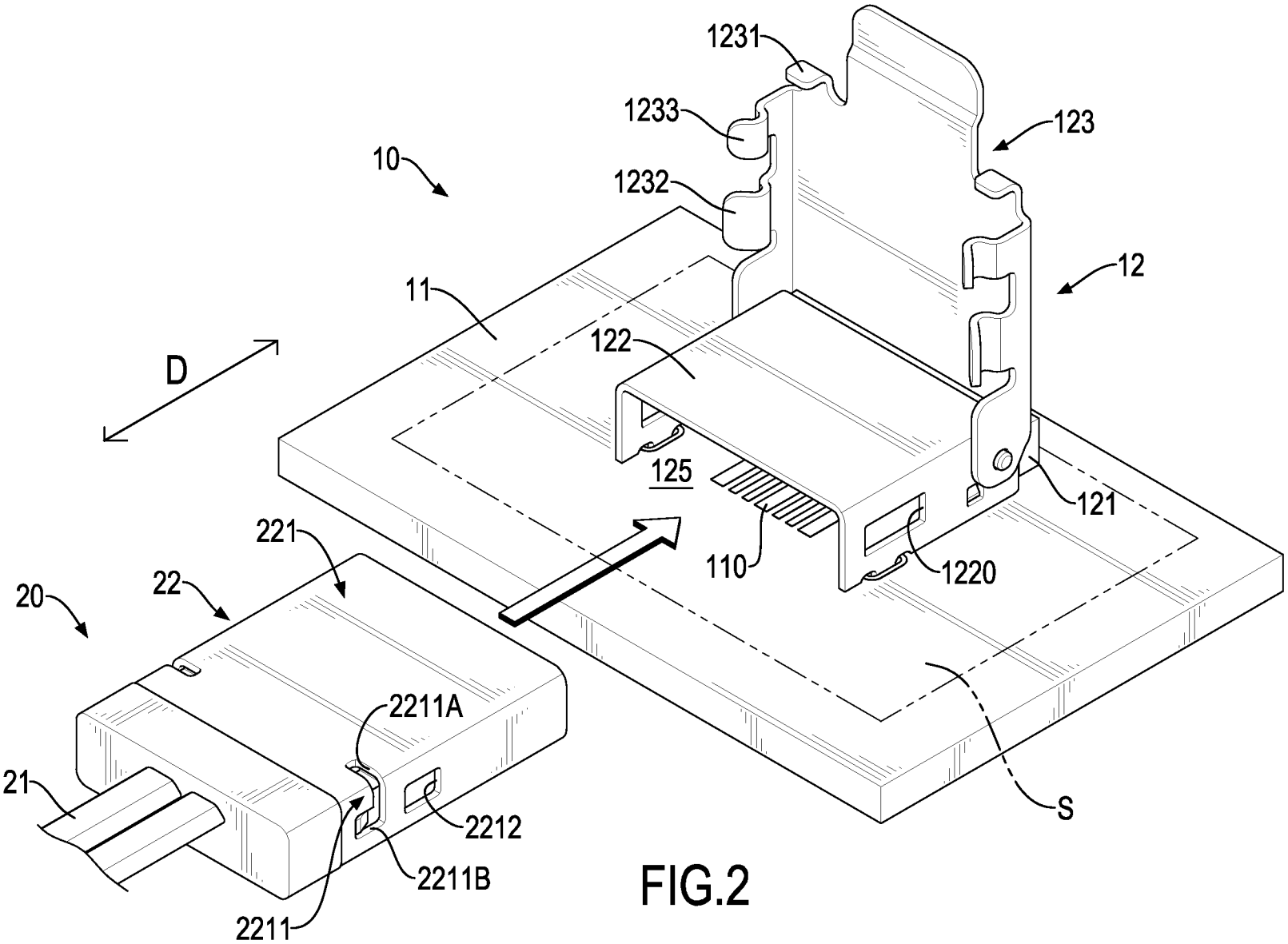
FIG. 2 is a perspective view of the anti-attenuation apparatus in FIG. 1, showing that an electronic device and a cable assembly are separated.
Figure 3:
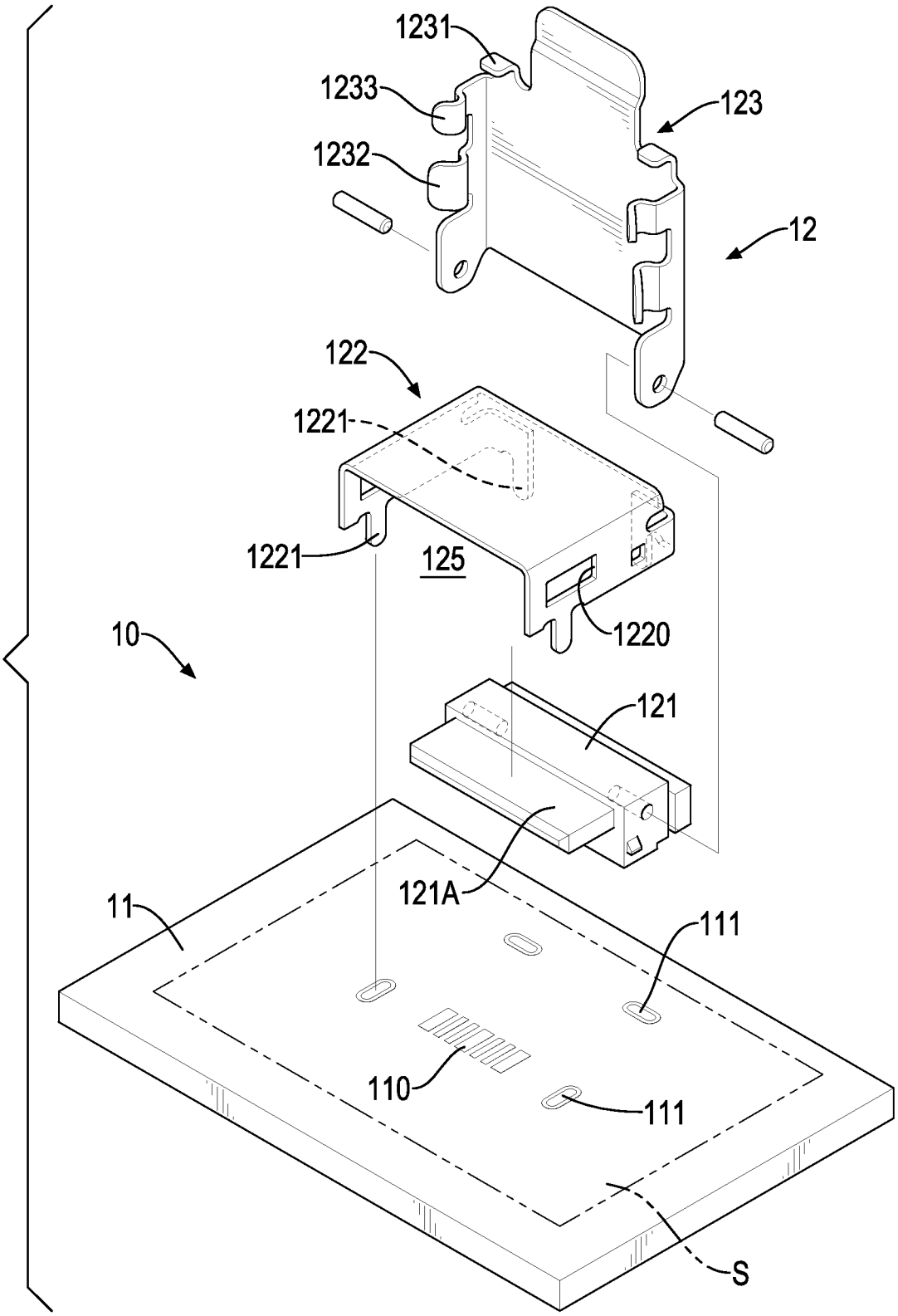
FIG. 3 is an exploded perspective view of the electronic device of the anti-attenuation apparatus in FIG. 1.

Please refer to both FIG. 2 and FIG. 3, the electronic device 10 may comprise a circuit board 11 and a securing assembly 12. The circuit board 11 has a plurality of through holes 111 formed thereon, and a plurality of metal pads 110 are mounted onto an upper surface of the circuit board 11. The securing assembly 12 is utilized to press elastic terminals 222 of the male connector 20 (i.e. the cable end connector) directly onto the metal pads 110 of the circuit board 11. Therefore, any board end connector can be omitted, an amount of junctions between the cable end connector 20 and the circuit board 11 is decreased, which results in better signal transmitting performance. To be specific, the said board end connector is defined as an element that is fixed onto a circuit board that comprises a plurality of conductive terminals therein, and each of the conductive terminals is utilized to be connected with the metal pads 110 of the circuit board 11 with a cable end connector.

In the present embodiment, the securing assembly 12 is mounted on the circuit board 11 and defines an inserting space therebetween for allowing the male connector 20 to be plugged therein via a front entrance and accommodating the male connector 20 therein. A reference surface S is defined as a virtual surface of an external component. The external component is defined as any component and is capable of contacting and electrically connected with the male connector 20, but the external component is not a board end connector or any elements (for example, terminals) within thereof. In the present embodiment, the external component is the circuit board 11. The securing assembly 12 comprises a base 121, a shield 122, a cover 123 and a plurality of shafts for connecting the base 121 and the cover 123.

The shield 122 having a plurality of connective legs 1221 for grounding, each of the connective legs 1221 extends downward and toward the circuit board 11. In the present embodiment, the connective legs 1221 are utilized to be inserted into and penetrates through the through hole 111 of the circuit board 11 and electrically connected and securely mounted thereto. Therefore, the shield 122 can be grounded via the connective legs 1221 with the circuit board 11. Moreover, the shield 122 can be formed of a one-piece formed sheet metal as depicted in FIG. 3.

In this embodiment, the shield 122 has at least one engagement recess 1220 formed on various lateral surfaces thereof, each of the various lateral surfaces of the shield 122 facing various directions. As depicted by FIG. 3, each of the engagement recesses 1220 is, for example, a through hole.

Figure 4:
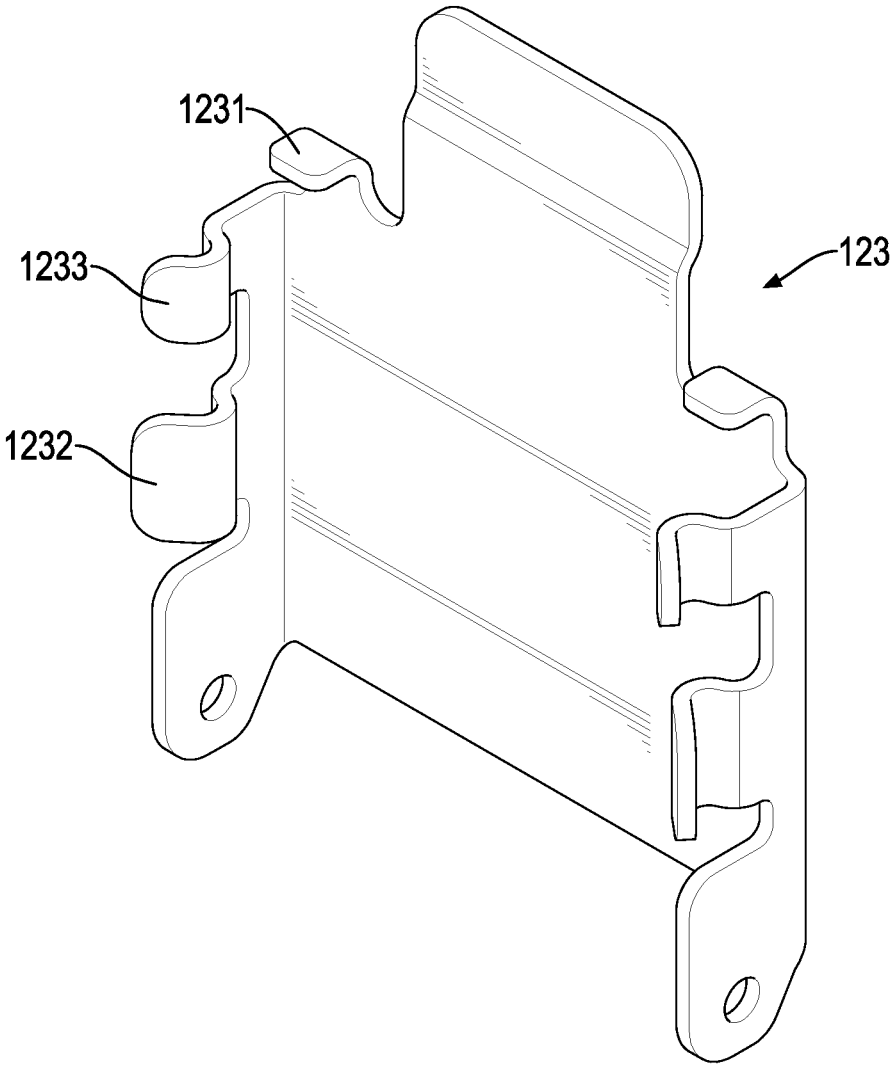
FIG. 4 is a perspective view of the electronic device in FIG. 3.

Please refer to FIG. 3 and FIG. 4. The cover 123 is configured to secure the male connector 20 within the inserting space 125 with the securing assembly 12. The cover 123 is rotatably mounted on the base 121 and is capable of rotating with respect to the shield 122. The cover 123 comprises at least one first engaging portion 1231, at least one second engaging portion 1232, and two third engaging portions 1233. As depicted by FIG. 3, at least one of the second engaging portion 1232 and the third engaging portions 1233 are formed at the same side of the cover 123, while the first engaging portion 1231 is not at the said side.

The base 121 has an abutting portion 121A being extended along a plugging direction D toward the front entrance defined by the shield 122, the abutting portion 121A has an inclined surface, at least part of the inclined surface facing downward toward the circuit board 11 as depicted in FIG. 3. The inclined surface can optionally be a flat inclined surface or a curved surface. Moreover, various lateral surfaces of the base 121 has a hook-shaped formed thereon, for securing the base 121 with the shield 122. In this embodiment, the shield 122 is covered or sleeved on the base 121. The space formed between the shield 122 and reference surface S on the circuit board 11 is defined as an inserting space 125. Moreover, at least part of the base 121 is disposed in the inserting space 125.

Figure 5:
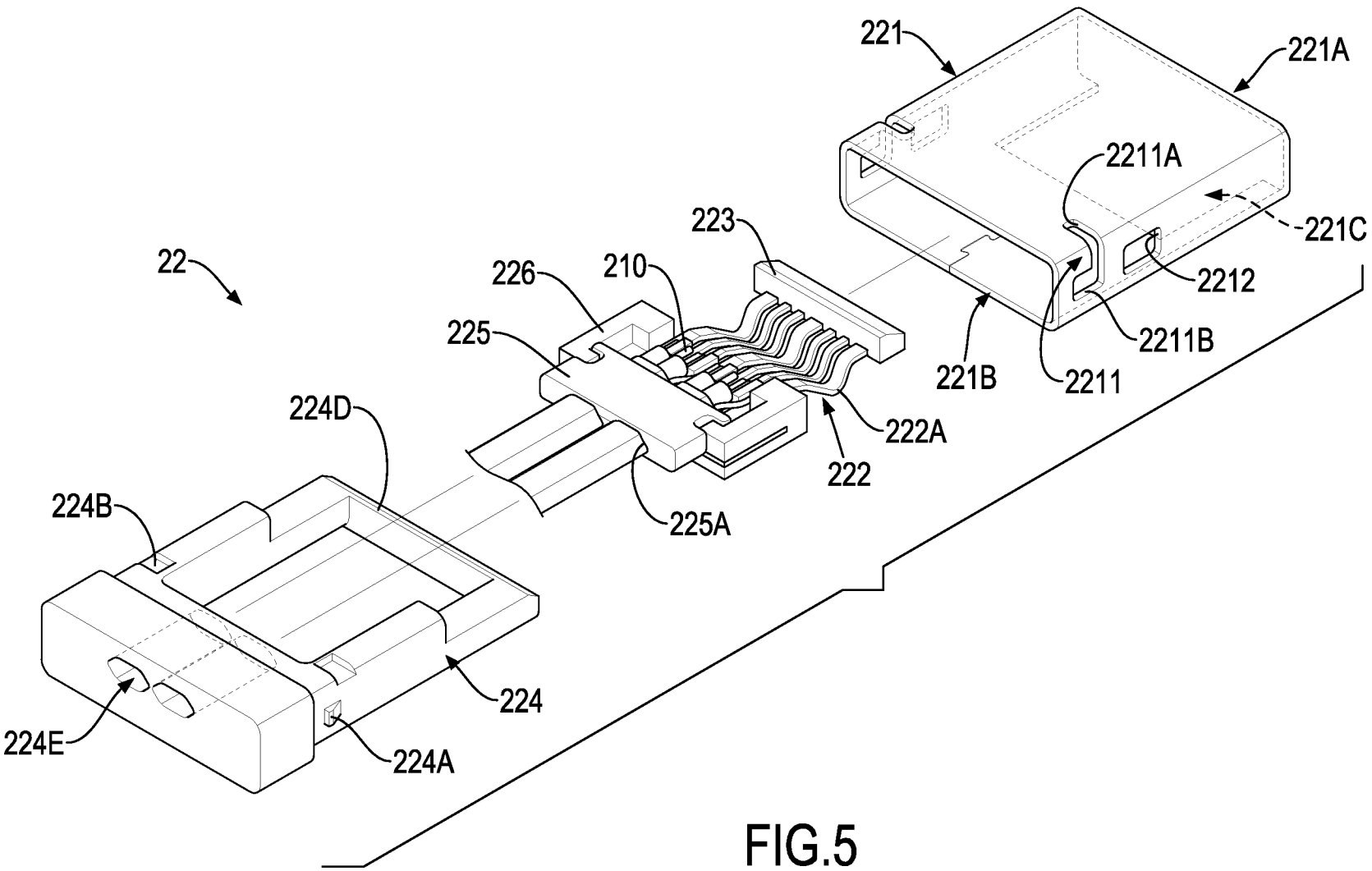
FIG. 5 is an exploded perspective view of an inserting connector of the cable assembly of the anti-attenuation apparatus in FIG. 1.
Figure 6:
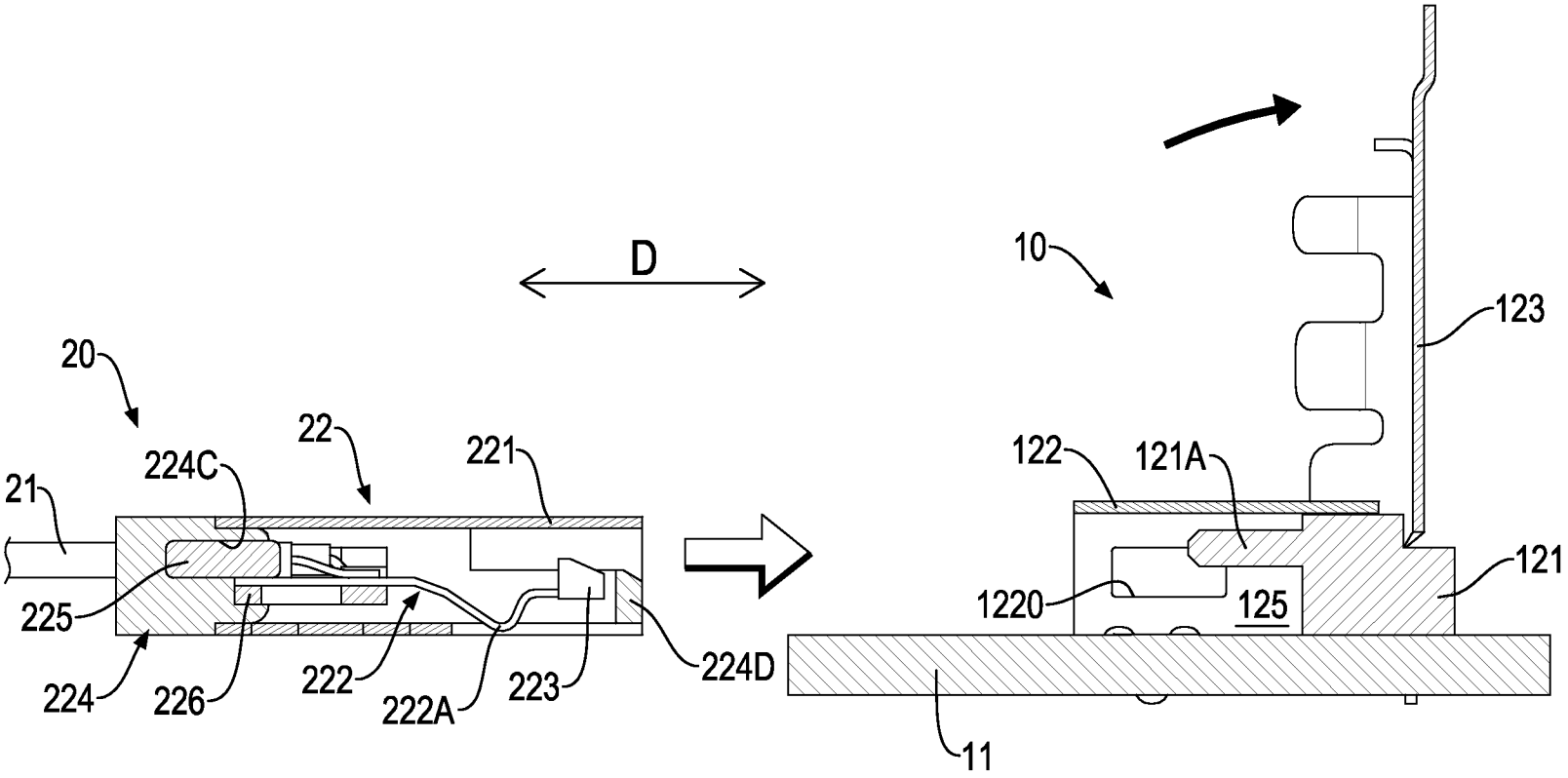
FIG. 6 is a sectional view of the anti-attenuation apparatus in FIG. 1, showing that the electronic device and the cable assembly are separated.

As depicted by FIG. 5 and FIG. 6, the male connector 20 comprises a cable module 21 and an inserting connector 22. The cable module 21 comprises a plurality of cables 210. The inserting connector 22 comprises a casing 221, a plurality of elastic terminal 222, a guiding unit 223, a protecting frame 224, a cable stand 225 and a pressing plate 226.

The casing 221 comprises two longer side surfaces (upper surface and bottom surface) and two shorter side surfaces (lateral surfaces) connected to each other. As depicted in FIG. 5, the casing 221 is approximately shaped as a flat rectangle tube that having a front opening 221A, a back opening 221B and a bottom opening 221C, which the front opening 221A and the bottom opening 221C are two interconnected through holes defined by the casing 221. The casing 221 is formed of a one-piece formed metal sheet as depicted in FIG. 5.

As depicted in the FIG. 5, a plurality of securing notches 2211 are formed on various latent surfaces of the casing 221, each of the securing notches 2211 is formed of a top notch 2211A and a lateral notch 2211B connected with each other. Each of the top notches 2211A is through holes formed on the upper surface of the casing 221 respectively and each of the lateral notches 2211B is a through hole formed on a lateral surface of the casing 221 respectively. Moreover, the casing 221 further having a plurality of through holes formed on both lateral surfaces thereof, being a restriction notch 2212 respectively. More specifically, the top notch 2211A of the securing notch 2211 are formed on one of the longer side surfaces, or say upper surface which is relatively distal from the reference surface S on the circuit board 11. The lateral notches 2211B and the restriction notches 2212 are respectively formed on the two shorter side surfaces.

As depicted in FIG. 5, each of the elastic terminal 222 has a rear end and a front end, the rear end is electrically connected with a cable 210 of the cable module 21 without using a circuit board for connection. Each of the elastic terminal 222 is a conductive, elastic metal terminal. In this embodiment, the elastic terminal 222 can be resiliently bent toward the reference surface S of the circuit board 11. Moreover, the elastic terminal 222 has a pre-bent protrusion 222A protruding downward towards the bottom opening 221C.

The guiding unit 223 is connected with the front end of the plurality of elastic terminals 222, the guiding unit 223 having an inclined surface, at least part of the inclined surface facing upward. In this embodiment, the front end of each of the elastic terminals 222 are secured with a shared guiding unit 223 and thereby all the elastic terminal 222 are connected and sharing force. Besides, such structure makes displacement of the elastic terminals 222 the same when the elastic terminals 222 are bent. In this embodiment, the guiding unit 223 and the elastic terminal 222 are two different elements, however, by bending the elastic terminal 222 into a certain shape to has the said incline surface, the end portion of the elastic terminal 222 can also function as the guiding unit 223, or say, the elastic terminal 222 can be one piece formed with guiding unit 223, Moreover, by a bridge liked structure connecting every end of the elastic terminal 222, the displacement of the elastic terminals 222 can also be maintained the same when the elastic terminals 222 are bent.

The protecting frame 224 is fixed inside the casing 221, the protecting frame 224 has a plurality of securing hooks 224A formed on two lateral surfaces thereof. Each of the securing hooks 224A is utilized to be buckled into the lateral notches 2211B of the casing 221 respectively. Moreover, an upper surface of the protecting frame 224 has a top groove 224B. At least part of the top notch 2211A is aligned with the top groove 224B for forming a common hole and allowing the first engaging portion 1231 of the cover 123 to penetrate therethrough so as to secure the cover 123 with casing 221 and the protecting frame 224. The protecting frame 224 encloses part of the elastic terminal 222 and the guiding unit 223, which prevents the elastic terminal 222 from over-bent and be damaged under unexpected force. Moreover, the protecting frame 224 is a frame-shaped hollow structure (or say a rectangular ring-shaped structure) for allowing the elastic terminals 222 to pass therethrough for contacting with the circuit board 11 via the bottom opening 221C of the casing 221. The protecting frame 224 has at least one first cable hole 224E formed on a lateral surface thereof, each of the first cable hole 224E is a closed-hole and the cable 210 passes through the first cable hole 224E to connect with the rear end of the elastic terminal 222.

The cable stand 225 has a second cable hole 225A, the second cable hole 225A is a closed-hole allowing the cable 210 to pass therethrough, the rear end of the elastic terminal 222 is clipped and secured between the cable stand 225 and the pressing plate 226. The cable stand 225, the elastic terminal 222, and the pressing plate 22, as a whole, are secured into an accommodating cavity 224C formed at an inner surface of the protecting frame 224 as depicted by FIG. 6.

After assembly of male connector 20 is completed as depicted by FIG. 6, by a blocking portion 224D (front bar) of the protecting frame 224 disposed between the inclined surface of the guiding unit 223 and the front opening 221A, the front opening 221A of the casing 221 exposes only a part of the inclined surface of the guiding unit 223 from the front opening 221A. Moreover, the bottom opening 221C exposing at least part of the protrusion 222A, the said term "expose" can be understood as, for example, "not covered".

Figure 7:
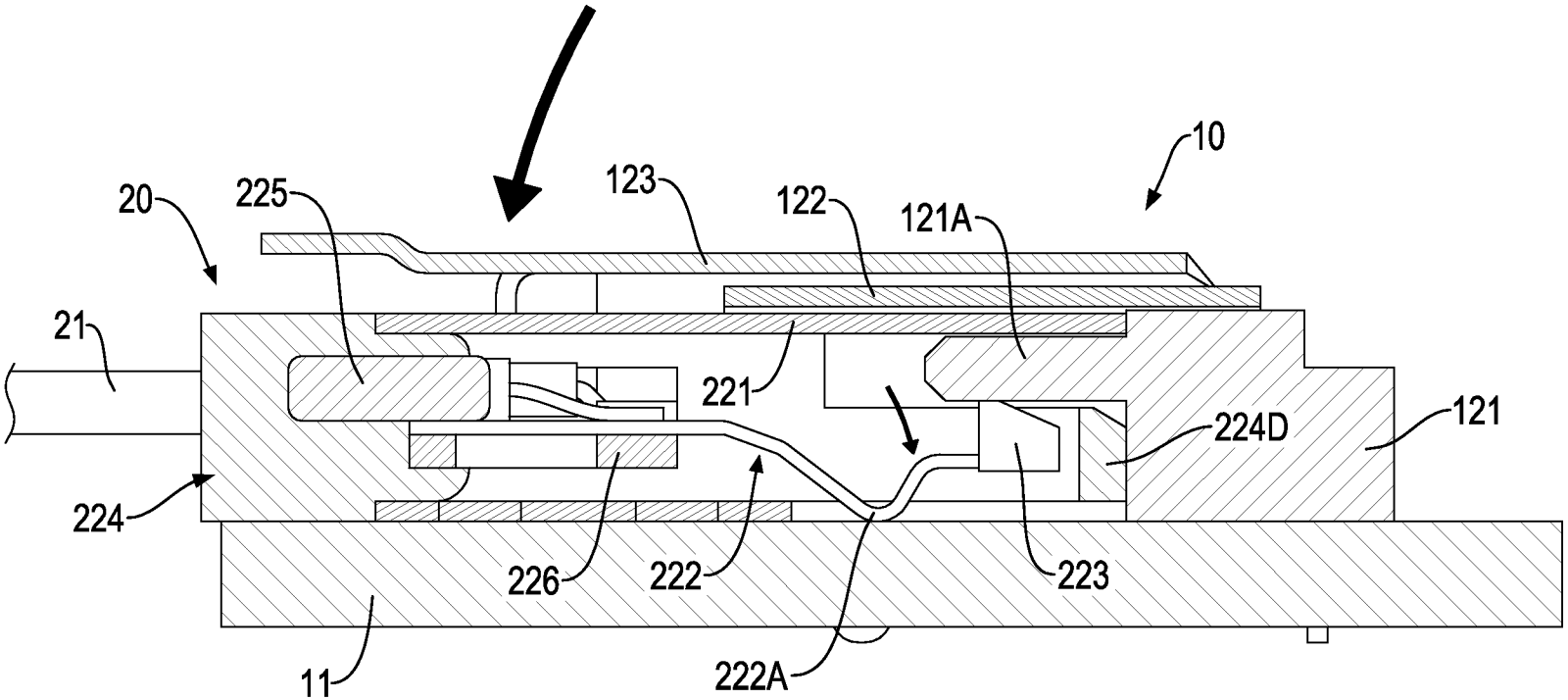
FIG. 7 is a sectional view of the anti-attenuation apparatus in FIG. 1, showing that the electronic device and the cable assembly are assembled.

Before assembling the male connector 20 with the electronic device 10, the cover 123 of the securing assembly 12 of the electronic device 10 should be lift opened as shown in FIG. 6, then the inserting connector 22 is pushed along the plugging direction D and be inserted into the inserting space 125 between the shield 122 as shown in FIG. 7 and the circuit board 11. At this time, the inclined surface of the abutting portion 121A of the securing assembly 12 abuts the guiding unit 223 connected to front end of the elastic terminal 222 and forces the elastic terminal 222 in the male connector 22 to deform and bend toward the circuit board 11, meanwhile, the protrusion 222A is bent and enters the bottom opening 221C thereof so the protrusion 222A can be firmly contacted and electrically connect with the metal pad 110, forming an electric connection.

Figure 8:
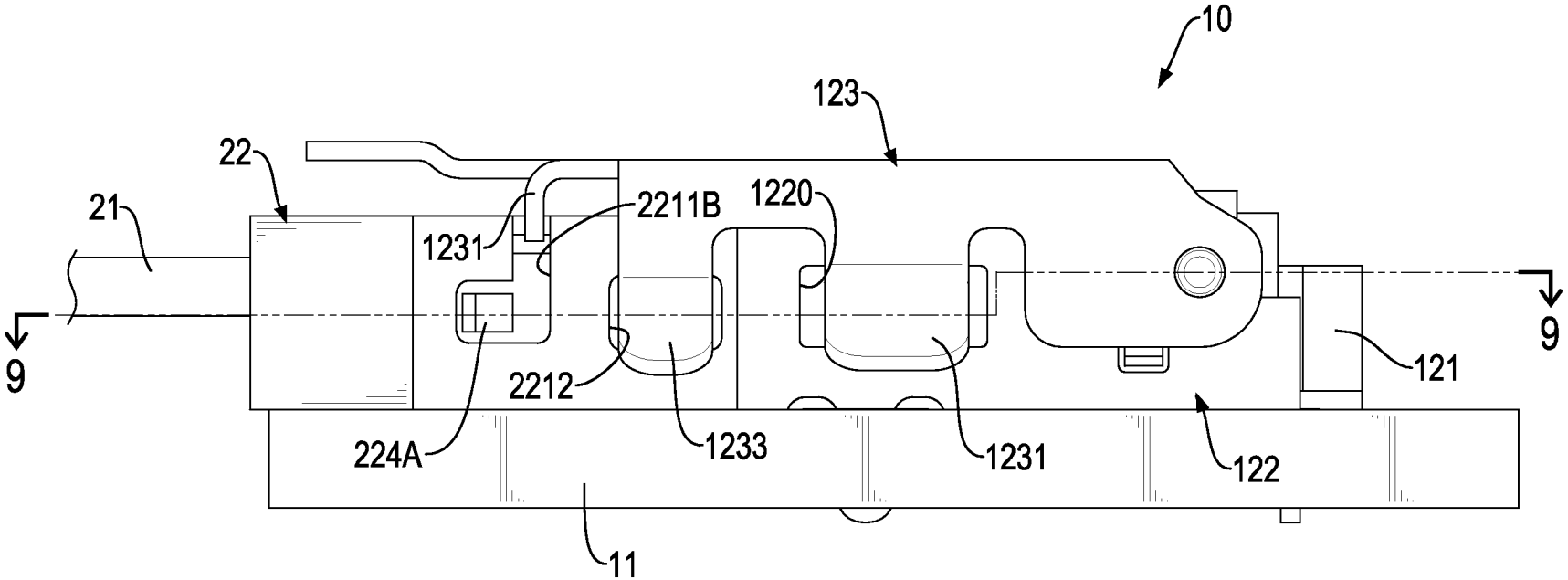
FIG. 8 is a side elevation view of the anti-attenuation apparatus in FIG. 1, showing that the electronic device and the cable assembly are assembled.
Figure 9:
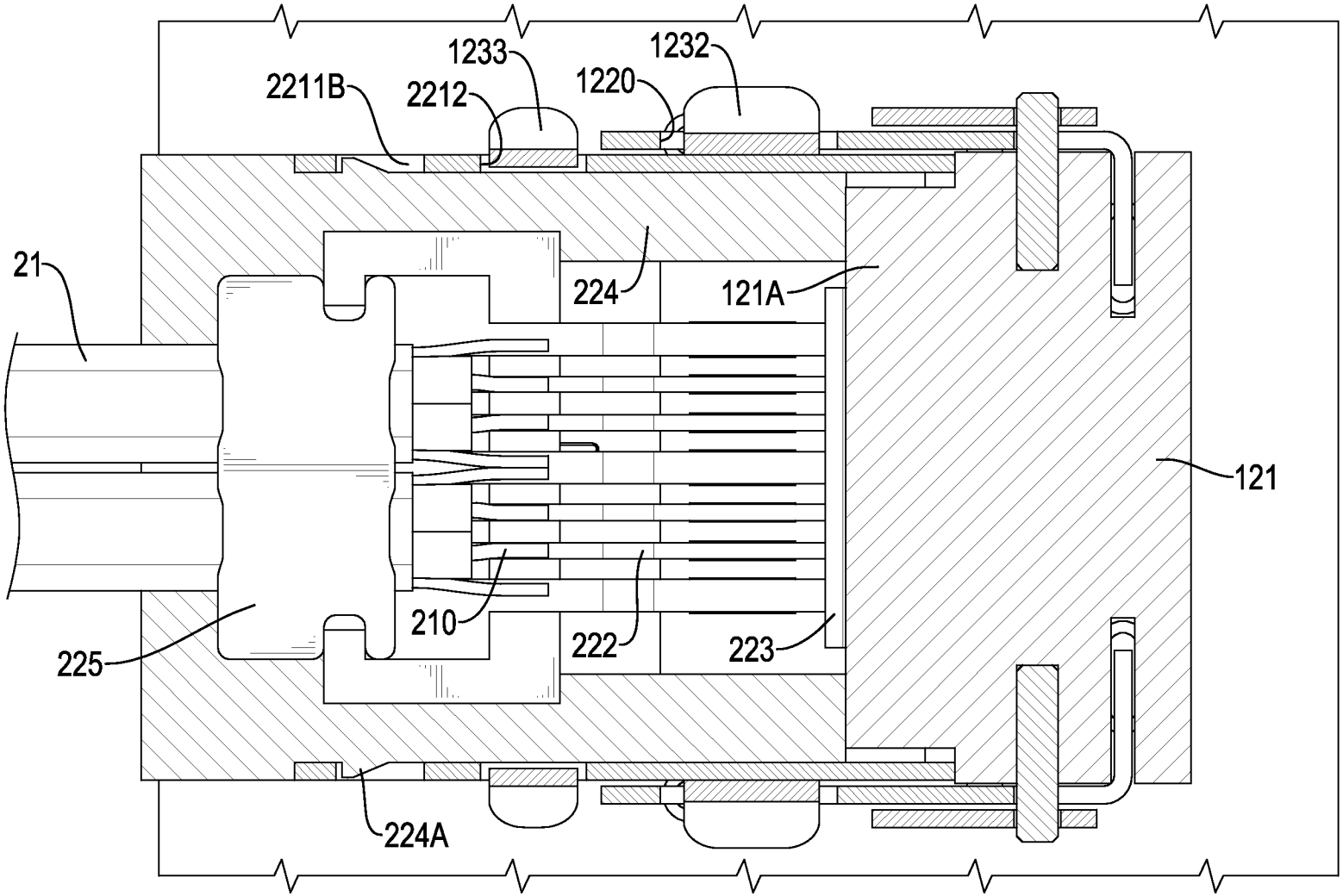
FIG. 9 is a sectional view of the anti-attenuation apparatus along line A-A in FIG. 8.
Figure 10:
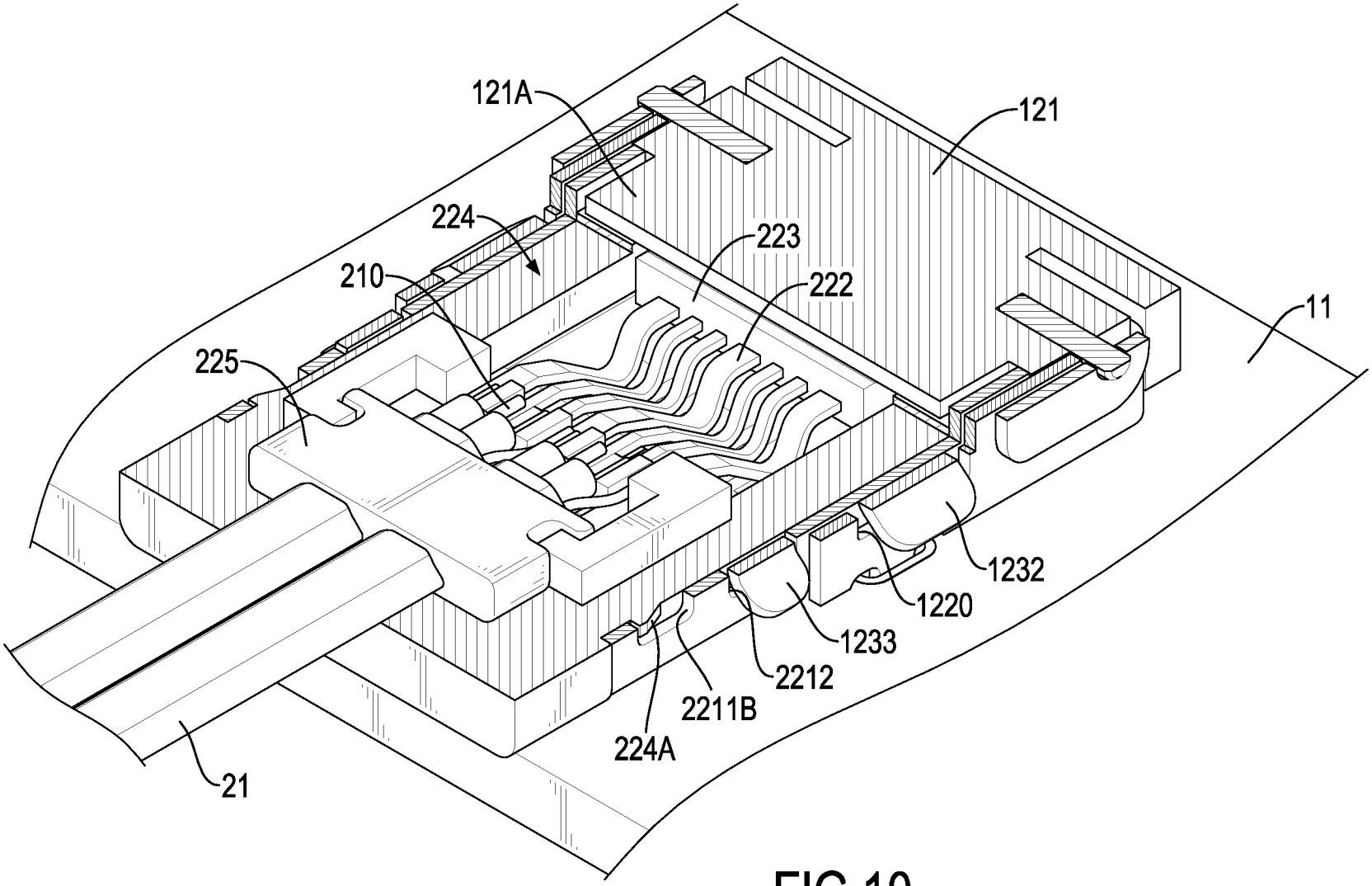
FIG. 10 is a perspective sectional view of the anti-attenuation apparatus along line A-A in FIG. 8.

Then, the cover 123 is rotated downward and be engaged with the inserting connector 22 as shown in FIG. 8, which makes the first engaging portion 1231 of the cover 123 plugged into and engaged with the securing notch 2211 of the inserting connector 22 and the third engaging portion 1233 of the cover 123 is plugged into and engaged with the restriction notch 2212 of the inserting connector 22. Therefore, such structure prevents the inserting connector 22 from being drawn out of the inserting space 125. Besides, with the third engaging portion 1233 clamping the inserting connector 22, the elastic terminal 222 may align to the metal pads 110, thereby forming firm an electric connection. In another embodiment, the elastic terminal 222 may be bent in advance rather than bent after the inserting connector 22 is inserted into the inserting space 125, which also makes the elastic terminal 222 firmly contact the metal pads 110. For example, both or one of the guiding unit 223 and the abutting portion 121A forms an inclined surface, the inclined surface is configured to guide the guiding unit 223 to move toward the board body of the circuit board 11 during abutting. In another embodiment, the inserting connector 22 may not comprise the guiding unit 223; instead, the abutting portion 121A may directly abut the elastic terminal 222.

Consequently, the anti-attenuation apparatus in accordance with the present invention is an electronic device 10 for being inserted and the other one is a male connector 20 for inserting. As a result, the electronic device 10 and the male connector 20 in accordance with the present invention can be assembled as a set of anti-attenuation apparatus.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A male connector, comprising:

a casing having a front opening and a bottom opening;

an elastic terminal having a front end, a rear end, and a protrusion, the protrusion protruding downward and located between the front end and the rear end, the protrusion formed by deforming the elastic terminal, the protrusion being electrically conductive, the rear end of the elastic terminal secured with the casing; and a guiding unit connected to the front end of the elastic terminal and having an inclined surface;

wherein, the front opening exposes at least part of the inclined surface of the guiding unit, the bottom opening exposes at least part of the protrusion, while the guiding unit is moved downward, the protrusion is deformed downward accordingly.

2. The male connector as claimed in claim 1, wherein at least part of the inclined surface faces upward, the bottom opening of the casing allows the protrusion to contact an external component via the bottom opening, the external component is neither a board end connector nor a terminal of the board end connector.

3. The male connector as claimed in claim 2 further comprising a protecting frame, at least part of the protecting frame being accommodated within the casing, the protecting frame having a blocking portion, the blocking portion disposed between the inclined surface of the guiding unit and the front opening of the casing for blocking only part of the inclined surface from the front opening.

4. The male connector as claimed in claim 3, wherein the protecting frame is a frame-shaped hollow structure for allowing the elastic terminal to penetrate therethrough to enter the bottom opening of the casing.

5. The male connector as claimed in claim 4, wherein the protecting frame has a plurality of securing hooks formed on two lateral surfaces thereof, each of the securing hooks is utilized to be engaged with a lateral securing groove of the casing respectively.

6. The male connector as claimed in claim 5, wherein the protecting frame has a top groove formed on an upper surface thereof, the casing has a top notch formed on a surface thereof facing upward, at least part of the top notch is aligned with the top groove for allowing an object to penetrate the top notch and be disposed within the top groove so as to secure the casing with the protecting frame.

7. The male connector as claimed in claim 6, wherein the bottom opening and the front opening of the casing are two interconnected through holes.

8. The male connector as claimed in claim 1, wherein the casing is formed in one piece from a metal sheet.

9. The male connector as claimed in claim 3, wherein the protecting frame is formed in one piece and has a first cable hole, the first cable hole is a closed-hole which allows a cable to pass therethrough to connect with the rear end of the elastic terminal.

10. The male connector as claimed in claim 9 further comprising a cable stand and a pressing plate, the cable stand having a second cable hole, the second cable hole being a closed-hole allowing the cable to pass therethrough, the rear end of the elastic terminal being clipped and secured between the cable stand and the pressing plate; wherein, the cable stand, the elastic terminal, and the pressing plate, are secured into an accommodating cavity formed on an inner surface of the protecting frame.

11. An anti-attenuation apparatus comprising:

a male connector as described in the claim 1; and a securing assembly, being adapted to cover a reference surface and thus forming an inserting space between the securing assembly and the reference surface for accommodating the male connector therein;

wherein, when the male connector is pushed into the securing assembly along a plugging direction, the protrusion of the elastic terminal is pressed toward the reference surface, wherein the reference surface is not defined by a board end connector or a terminal of the board end connector.

12. The anti-attenuation apparatus as claimed in claim 11, wherein, the securing assembly comprising:

a shield adapted to be connected to the reference surface and thus forming the inserting space between the shield and the reference surface;

a base, at least part of the base being disposed in the inserting space, the base having an abutting portion extending along the plugging direction, the abutting portion adapted to press the inclined surface of the guiding unit toward the reference surface.

13. The anti-attenuation apparatus as claimed in claim 12, wherein the shield has a plurality of connective legs for grounding purpose.

14. The anti-attenuation apparatus as claimed in claim 13, wherein the shield has a plurality of engagement recesses formed on various lateral surfaces of the shield.

15. The anti-attenuation apparatus as claimed in claim 12, wherein the shield is formed in one piece from a metal sheet.

16. The anti-attenuation apparatus as claimed in claim 12 further comprising a cover rotatably connected to the base of the securing assembly, the cover having at least one first engaging portion, each of the first engaging portion adapted to penetrate through a top notch formed on the casing and a top groove formed on an upper surface of a protecting frame, the protecting frame accommodated within the casing.

17. The anti-attenuation apparatus as claimed in claim 16, wherein the cover has a second engaging portion and a third engaging portion, the second engaging portion is adapted to be inserted into an engagement recess formed of the shield, the third engaging portion is adapted to be inserted into a restriction notch formed on a lateral surface of the casing, and the second engaging portion and the third engaging portion are configured to secure the male connector with the securing assembly.

18. The anti-attenuation apparatus as claimed in claim 17, wherein the cover is formed in one piece from a metal sheet.

19. A plug, comprising:

a casing having a front opening and a bottom opening; and an elastic terminal having a front end, a rear end, and a protrusion, the protrusion located between the front end and the rear end, the protrusion formed by deforming the elastic terminal, the protrusion being electrically conductive, the rear end of the elastic terminal secured with the casing, the front end of the elastic terminal having a guiding portion;

wherein, while the guiding portion is moved downward, the protrusion is moved downward accordingly; the front opening exposes at least part of an inclined surface of the guiding portion, and the bottom opening exposes at least part of the protrusion.

* * * * *